United States Patent [19]

Armstrong

[11] 3,946,531

[45] Mar. 30, 1976

[54] MUNTIN BAR UNITARY FRAME

[75] Inventor: Henry P. Armstrong, Islington, Canada

[73] Assignee: Elca Designs Limited, Toronto, Canada

[22] Filed: Jan. 27, 1975

[21] Appl. No.: 544,108

[52] U.S. Cl. ..... 52/456; 52/668; 52/758 A

[51] Int. Cl.[2] ..... E06B 3/70

[58] Field of Search ..... 52/667, 456, 758 A, 668

[56] References Cited

UNITED STATES PATENTS

| | | | |
|---|---|---|---|
| 3,280,523 | 10/1966 | Stroud et al. | 52/616 |
| 3,293,817 | 12/1966 | MacGregor | 52/456 |
| 3,678,651 | 7/1972 | Hicks | 52/456 X |
| 3,748,814 | 7/1973 | Cribben | 52/668 |
| 3,791,095 | 2/1974 | Martin | 52/456 |

*Primary Examiner*—Frank L. Abbott
*Assistant Examiner*—Carl D. Friedman
*Attorney, Agent, or Firm*—Wegner, Stellman, McCord, Wiles & Wood

[57] ABSTRACT

A muntin bar unitary frame for disposition in confronting planar relationship to a glass pane to provide a visual appearance of the window glazing generally that of a divided glass assembly. The muntin bar unitary frame has a plurality of bars arranged in a desired pattern, with each of the bars being hollow with an internal central planar strengthening web defining a pair of tubular cavities and with a cross-joint where two bars intersect being formed by cutting of the two bars and reducing the thickness of the central web of the two bars to bring the central web surfaces in juxtaposed relation for bonding of the bars together. The planar walls of a bar for disposition adjacent glass panes each have raised ribs along the edge thereof to prevent contact of the planar walls with the surfaces of the glass panes.

5 Claims, 5 Drawing Figures

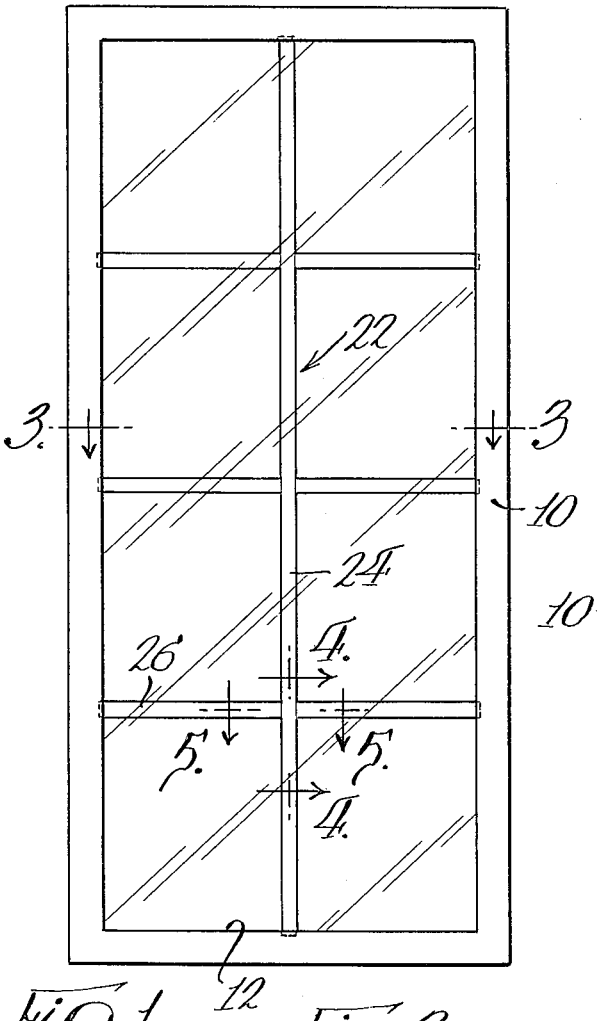
Fig. 1.
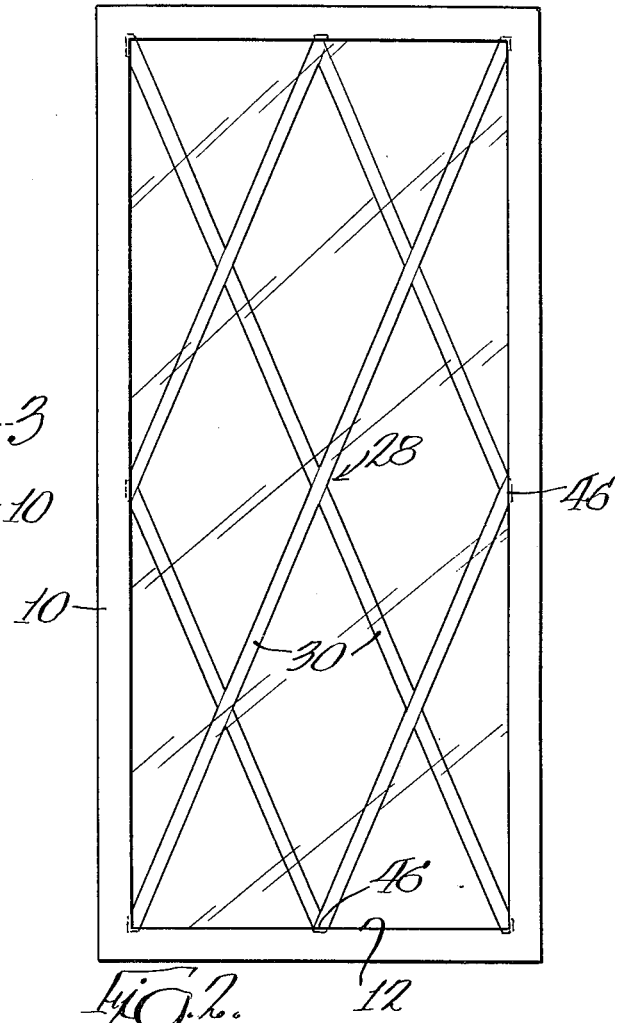
Fig. 2.
Fig. 3.
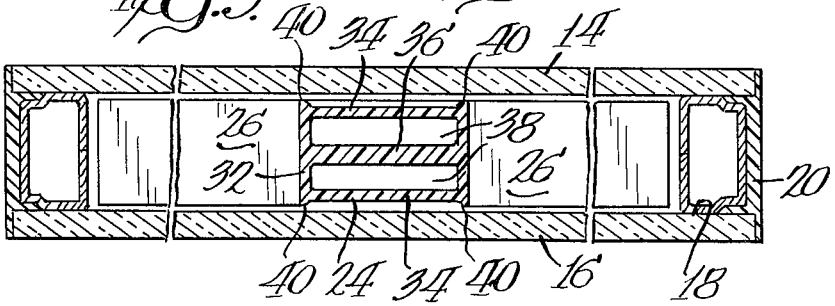
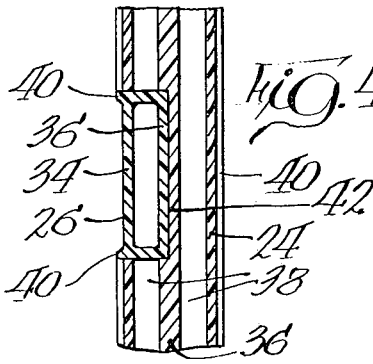
Fig. 4.
Fig. 5.
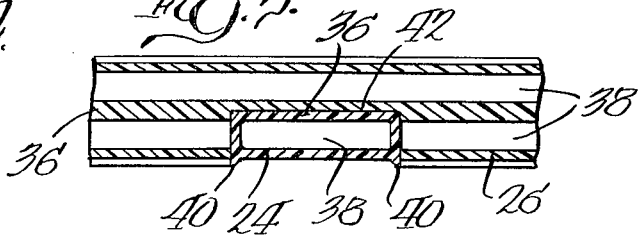

MUNTIN BAR UNITARY FRAME

BACKGROUND OF THE INVENTION

This invention pertains to the art of windows embodying fixed or ventilator sash or fixed glazing in a wall structure, such as may be suitable for residential, apartment, commercial or other types of buildings. More specifically, the invention relates to the formation and application of a muntin bar unitary frame forming a decorative grille or lattice and for positioning in confronting planar relationship to a glass pane to provide a visual appearance for the window of a divided glass assembly, such as in a window of Colonial, Georgian, or other architectural tradition.

Location of a muntin bar unitary frame in confronting and planar relationship to a large glass pane, or inside of a multiple pane insulating glass unit, is common practice. This invention relates specifically to the design and structural formation of such a frame.

Heretofore decorative frames intended to simulate the appearance of muntin bars have been die-moulded in thermoplastic material and have been quite practical in application to window sash. Due to the very wide range of sash shapes and sizes now required, particularly for large glass areas, and, in turn, high tooling costs, one-piece moulded plastic frames are generally uneconomical for residential-type windows.

In residential construction, the use of windows glazed with hermetically sealed double pane insulating glass units is rapidly increasing. By positioning an insert type divider grille or muntin bar unitary frame in the cavity between the glass panes, the visual appearance of the glazed window sash may be that of a multiple pane unit, yet the inside and outside glass surfaces are large, flat and easy to clean. It has been common practice to manufacture insert type divider frames from plastic extrusions of tubular bar formation. Such frames may comprise several overlapping and mortised diagonal bars, or vertical and horizontal crossjointed bars, united at the ends thereof to a perimetrical edge bar structure. Frames of such type may include several bar members and joints which limit rigidity and strength; require precise and painstaking assembly, including difficult bonding procedures; and very careful handling when coordinating same with a process of manufacturing insulating glass units. Accordingly, production costs are excessive for rectangular-shaped units, and uneconomical for frames of diamond configuration.

SUMMARY

A primary feature of the invention is to provide a muntin bar unitary frame made of tubular bars to minimize the cost of material used in the bars and with a design thereof which facilitates assembly of a plurality of bars into a desired pattern and which enhances the appearance of the frame in use.

All of the bars used in the muntin bar unitary frame are of the same basic construction having a generally rectangular cross-section with a central strengthening web defining a pair of tubular cavities extending lengthwise of the bar. This structure provides for a cross-joint between intersecting bars wherein the two bars are appropriately cut for interfitting and with the central web of each being reduced in thickness to have the cross-joint no thicker than the thickness of a single bar with the surfaces of both central webs providing a large area of abutting contact for receiving adhesive or cement for bonding the bars together and providing a strong joint facilitating handling and installation of the muntin bar unitary frame within an insulating glass unit and further providing increased strength for unsupported ends of the bars.

The bars of the muntin bar unitary frame are preferably formed of extruded rigid plastic, such as vinyl, with the cross-sectional shape thereof being generally rectangular and having a pair of planar walls which may have a selected width for the desired proportioning to conform with the frame pattern size of the glass panes and sash and the style or type of window. The bar can be extruded generally true to shape, without deformation when cooling in the extrusion process, but additionally is provided with raised ribs at both edges of the planar walls to permit only minimal contact with the surfaces of adjacent glass panes and to insure lack of contact between a glass pane and a planar wall of the bar to preclude light diffusion and trapped air spaces between the glass and the bar.

With the structure described herein, a muntin bar unitary frame mayhh be easily manufactured, with economical use of materials, and with adequate strength to avoid requirements for external or marginally surrounding frame elements. In the assembly, an adhesive or cement may be placed between the related surfaces of the central webs of reduced thicknesses, whereby there is no run-out of adhesive and which eliminates cleanup problems with currently existing muntin bar unitary frames wherein the adhesive is placed between exposed surfaces of intersecting bars.

BRIEF DESCRIPTION OF THE DRAWINGS

FIG. 1 is an outside view of a window sash, glazed with an insulating glass pane containing a muntin bar unitary frame in rectangular pattern;

FIG. 2 is an outside view of a window sash, glazed with an insulating glass pane containing a muntin bar unitary frame in diamond pattern;

FIG. 3 is an enlarged cross section of the insulating glass pane, separate from the sash frame, taken on the arrowed line 3—3 in FIG. 1, and showing parts of the muntin bar unitary frame in the glass pane cavity;

FIG. 4 is a fragmentary vertical section of a portion of the muntin bar unitary frame, separate from the insulating glass pane, taken on the arrowed line 4–4 in FIG. 1, and FIG. 5 is a fragmentary horizontal section of a portion of the muntin bar unitary frame, separate from the insulating glass pane, taken on the arrowed line 5—5 in FIG. 1.

DESCRIPTION OF THE PREFERRED EMBODIMENT

A sash frame 10 is shown in FIGS. 1 and 2 which may be used as either a fixed or movable window unit and which is the same sash frame but which has different patterns of muntin bar unitary frame structure associated therewith. The sash 10 has a glass sight line 12 and, as shown particularly in FIG. 3, the glazing is an insulating glass unit having spaced-apart glass panes 14 and 16 retained in spaced relationship by a peripheral tubular spacer frame 18 which is hermetically sealed around its perimeter and between the faces of the glass panes 14 and 16 at their edges with an elastomeric adhesive sealant 20.

A function of the adhesive sealant 20 is to prevent migration of moisture vapor into the cavity between the glass panes 14 and 16. The structural formation as well as the general shape of the sash is not pertinent to the invention disclosed herein; however, the insulating glass unit, as shown in FIGS. 1 to 3, is particularly suitable for use therewith of the muntin bar unitary frame embodying the invention disclosed herein.

The muntin bar unitary frame having a generally rectangular pattern, is indicated generally at 22 in FIG. 1. This frame has a vertical bar 24 extending for the height thereof and a plurality of vertically spaced horizontal bars 26 which are assembled together in a manner to be described in order to form the rectangular pattern shown in FIG. 1. An alternate style, such as a diamond style muntin bar unitary frame, is indicated generally at 28 in FIG. 2 wherein a plurality of diagonally arranged bars 30 are disposed in the relation shown in FIG. 2 to provide the diamondstyle. The bars 24, 26 and 30 are in the form of an extruded rigid plastic, such as vinyl or other suitable material, in order to have stability and particularly resistance to deflection as well as being of light weight and being attractive in appearance. Each of the bars 24, 26 and 30 is of the same structural design with the shape of the bar 24 being shown in cross section in FIG. 3. The bar is of a generally rectangular cross section, having a pair of planar edge walls 32 interconnected by a pair of planar walls 34 arranged to be closely adjacent to the inner surfaces of the glass panes 14 and 16. The bars are generally hollow, with a continuous central planar strengthening web 36 extending generally parallel to the planar walls 34 and defining two cavities 38 therebetween which extend lengthwise of the bar.

A pair of ribs 40 extend outwardly from each of the planar walls 34 to, in effect, recess the face of the planar wall at an assured distance from the inner face of the glass panes 14 and 16.

As will be seen in FIGS. 1, 4 and 5, the plurality of horizontal bars 26 intersect the vertical bar 24 at cross-joints which are formed as shown particularly in FIGS. 4 and 5. The central strengthening webs 36 of the vertical bar 24 and the horizontal bar 26 are of a sufficient width whereby the thickness of each can be reduced approximately by 50%, which still leaves a complete tubular section with a cavity 38 and which provides strength for the bar and wherein, additionally, the cross-jointed bars may be brought together and with the entire thickness of the cross-joint being no greater than the thickness of one of the bars. In manufacture, a machining or cutting operation cuts through a planar wall 34 and both edge walls 32 of a bar and also removes approximately half the thickness of the central web. A corresponding cut is made through the other bar whereby the two bars may be assembled as shown in FIGS. 4 and 5.

The opposed surfaces of the two central webs 36 which have been reduced in thickness at the cross-joint are placed in abutment, as indicated at 42, to provide a relatively large area for bonding of the bars together by placement of a bonding agent, such as an adhesive or contact cement therebetween.

In FIG. 2, the diagonally crossed bars 30 are cross-jointed in the same manner as described, with the cuts through the planar walls 34 being at an angle to the length of the bar, rather than normal thereto in the rectangular pattern arrangement of FIG. 1. The ends 46 of the bars 30 may be machined and half lapped through the central strengthening webs 36 and joined by an adhesive or contact cement.

It is practical to insert a muntin bar unitary frame as described in a one-half inch width space between glass panes. Although given as an example and not intended to be limiting, the bars 24, 26, and 30 can have the edge walls 32 and planar walls 34 approximately 0.040 inch thick, with the central strengthening web 36 being approximately 0.080 inch thick. The ribs 40 may protrude approximately 0.020 inch from the external face of the planar walls 34 and the overall thickness across the external rib edges should be about 0.040 inch less than the related width of the internal space between the glass panes 14 and 16. The width of the bars 24, 26 and 30 and, specifically the width as defined by a planar wall 34, may be suitably proportioned to conform with the frame pattern, size of the glass panes and the sash as well as the style or type of window. In one example as shown in FIG. 3, the width is ¾ of an inch relative to a one-half inch glass space.

As shown in FIG. 3, the ends of the bars 24 are spaced from confronting faces of the tubular spacer frame 18 to permit longitudinal expansion of the bars within the insulating glass cavity. All muntin bars should be dimensioned to allow for thermal expansion.

In assembling the insulating glass unit and the muntin bar unitary frame, the latter is first completely preassembled. A preassembled tubular spacer frame 18 is placed around the marginal edges of one of the glass panes 14 and 16 and then the muntin bar unitary frame is placed on the glass pane inside of the spacer frame 18. A second glass pane is then placed in position and the glass assembly hermetically sealed by the sealant 20 applied around the perimeter thereof, with the muntin bar unitary frame captured therebetween. It is then possible to clean the exposed faces of the glass panes 14 and 16, without any contact with the muntin bar unitary frame. As pointed out above, the dimension of a bar from tips of opposite ribs 40 is slightly less than the glass cavity space and, additionally, the ribs function to avoid contact of the planar walls 34 with the internal surface of the glass panes 14 and 16. It is thus possible to have uniform conditions within the interior of the insulating glass unit and to have uniform appearance of the muntin bar unitary frame between the glass panes without random contact of the planar walls 34 with the internal surfaces of the glass panes. The sealing of intersecting bars at a cross-joint is done entirely internally and hidden from view and, thereby there are no cleanup problems with respect to the use of an adhesive or contact cement in assembling the muntin bar unitary frame.

I claim:

1. A muntin bar unitary frame comprising a plurality of bars arranged in a desired pattern with at least one cross-joint wherein two of said bars intersect, each of said bars being hollow with a central planar strengthening web defining a pair of tubular cavities extending lengthwise thereof, said central web of each bar having a thickness to have a part thereof at each side of a longitudinal central plane of the bar, and said central web of two bars at a cross-joint being reduced in thickness by removal of a part at one side of a longitudinal central plane to provide juxtaposed planar bonding surfaces meeting along said longitudinal central plane and with the thickness of the frame at the cross-joint being substantially the same as that of a single bar.

2. A muntin bar unitary frame as defined in claim 1 wherein the central strengthening web has a thickness approximately twice that of the peripheral wall of the bar.

3. A muntin bar unitary frame positionable between spaced glass panes of an insulating glass unit comprising a plurality of generally rectangular elongate bars arranged in a desired pattern with at least one cross-joint wherein two of said bars intersect, each of said bars having a pair of opposite planar walls positionable one adjacent each of said spaced glass panes and a central internal planar strengthening web parallel to said planar walls and defining a pair of elongate tubular cavities located one at either side of said central web, said central web of each bar having a thickness sufficient whereby the thickness of the central webs of two bars at an overlapping cross-joint are reduced to interfit two intersecting bars with mechanical interlocking of said bars by edge contact of said central webs where they overlap and with the opposed planar surfaces of said two central webs at the cross-joint providing abutting planar surface areas for bonding together to hold the bars in assembled relation.

4. A muntin bar unitary frame as defined in claim 3 wherein said bars are of extruded rigid plastic and a pair of ribs extend outwardly one from each edge of a planar wall to prevent contact between a planar wall and the adjacent glass pane.

5. A muntin bar unitary frame having a plurality of elongate extruded plastic bars arranged in a desired pattern, each of said bars being of a hollow generally rectangular cross-section with a pair of external planar walls and a central strengthening web parallel to said planar walls, said central web extending across the width of the bar to define a pair of tubular cavities therebetween, at least one cross-joint where two of said bars intersect and each of said bars being cut to an equal depth at said cross-joint to interfit and with the central web of each of said bars being reduced in thickness at the cross-joint to have the bars overlap with the thickness at the overlap being no greater than the thickness of a bar, and said central webs having opposed planar surfaces at the cross-joint in face-to-face relation and bonded together to hold the bars in assembled relation.

* * * * *